United States Patent [19]

Mueller

[11] Patent Number: 4,783,355

[45] Date of Patent: Nov. 8, 1988

[54] TEXTILE WEB MADE OF WOVEN OR KNITTED FABRIC

[76] Inventor: Peter Mueller, Richard-Wagner Str. 2, D- 5276 Wiehl, Fed. Rep. of Germany

[21] Appl. No.: 834,714

[22] Filed: Feb. 28, 1986

[30] Foreign Application Priority Data

Mar. 4, 1985 [DE] Fed. Rep. of Germany ..... 3508864

[51] Int. Cl.[4] ..... B65D 65/28

[52] U.S. Cl. ..... 428/43; 428/225; 428/229; 428/253; 428/257; 428/373

[58] Field of Search ..... 428/54, 56, 43, 224, 428/225, 229, 253, 257, 373

[56] References Cited

U.S. PATENT DOCUMENTS 3,945,096 3/1976 Miranker ..... 83/53

4,259,394 3/1981 Hhan ..... 428/234

*Primary Examiner*—James J. Bell

*Attorney, Agent, or Firm*—Francis J. Bouda

[57] ABSTRACT

The invention relates to a textile web made of woven or knitted fabric which includes essentially longitudinally processed continuous mixed fiber or bi-component threads in relation to the course of the web, with a first type of fiber which forms the substantial portion of the threads or loops running in the direction of the web and which can be thermoplastically formed or separated at a first raised temperature, and with a second type of fiber which forms a smaller part of the threads or loops running in the direction of the web and is essentially structurally unchangeable during the first raised temperature. The invention also relates to a process including a first process step (preseparation) after the weaving or knitting process wherein the fibers of the first type of fibers are thermoplastically separated by heating a section of the web lying crosswise to the course of the web, and in a second process step (final separation) preceding further processing and/or final use, the fibers of the second type of fiber are separated in that section previously subjected to thermoplastic separation. The process of the final separation can be manually accomplished in a simple manner, whereby the cost for separation of the web into individual pieces is considerably reduced.

2 Claims, 3 Drawing Sheets

TEXTILE WEB MADE OF WOVEN OR KNITTED FABRIC

BACKGROUND OF THE INVENTION

The invention relates to a textile web made of woven or knitted fabric which includes essentially longitudinally processed continuous mixed fiber or bi-component threads in relation to the course of the web and which for further processing and/or final use can be essentially separated crosswise into individual pieces, and a process for production of partially ready-made or fully ready-made individual pieces made of woven or knitted fabric (especially garments or parts of garments) and partially ready-made or fully ready-made individual pieces made of woven or knitted fabric, which are made of web according to the invention or according to the process according to the invention.

The field of application of the invention relates to all fields of textile production in which partially ready-made or fully ready-made individual pieces, especially garments, are produced from a continuous web. This is particularly advantageous in the field of knot and double rib goods in which the processing of ready-made garments has progressed far in the production. However, an application in the field of woven products can also be achieved.

According to a known process, a finished knitted web is continuously wound on rollers or fed into cartons, and later on is separated into individual pieces, optionally after intermediate treatment of the web. Originally this separation process was performed only manually by cutting crosswise to the direction of the web, which entailed a considerable share in labor costs. In the meantime, automatic devices have become known that draw in the wound or folded material and automatically separate the individual pieces. This process is also too expensive since, for costing purposes, the labor costs for cutting are in the same order of magnitude as the labor costs for knitting, whereby together they are in the order of magnitude of the material costs.

SUMMARY OF THE INVENTION

In the present invention, the possibility arises for severing the thermoplastic fiber parts of the web in a preseparation process step directly following the production of the web and controlled together with it, while the thermally more resistant fiber portions remain intact and keep the integrity of the web. The portion and the dimensioning of the connecting fiber parts should be able to absorb in a nondestructive manner all longitudinal forces in the web occurring during further conveying or further processing. This guarantees that all subsequent process steps and conveying steps can be carried out in an unchanged manner, while the final separation process, which, e.g., can take place by the consumer directly before use, is considerably facilitated and should be able to take place by applying a briefly increased pull, such as by manual tearing. This also includes variations in which the separation is performed, e.g., by using a knife or another cutting tool, since in each case the line of separation is marked and comprises only a few carrying threads that can be easily cut while the fusible threads are already previously thermoplastically separated along the cutting line. Of course, there is also the possibility of dividing the carrying threads, too, depending on the material, by thermoplastic forming or by thermal burning through with a tool that can be manually operated or a fixed device. The severing of the fusible threads in the first process step makes it possible for the final separation process to take place more rapidly.

One way to accomplish this is to produce the lengthwise threads in part as fusible threads made of a material that can be thermoplastically changed, such as, e.g., polyester, and to provide a specific portion or a specific number of carrying threads made of a thermally more resistant material, such as a natural fiber. However, the invention also extends to the possibility of spinning or drawing the threads, or a part thereof, from a portion of fibers that can be thermoplastically formed and a portion of thermally more resistant fibers. In these bi-component threads, after the first step of the thermal preseparation, only a portion, e.g., a core area, remains as carrying portion that can be severed more easily later on. Glass and carbon fibers are also suitable for the thermally resistant type of fiber or the core of a bi-component fiber. The product Nomex (Dupont tradename) has turned out to be a suitable material for the heat resistant portion of the fibers; its melting point is around 420 degrees centigrade. The polyamide fibers are stable under the effect of a hot wire of about 1300 degrees centigrade at red heat for a period of 10 seconds.

For the further handling of the web, it is advantageous to provide at least two carrying threads which should be preferably placed one in each edge section of the web. Variations in the number and the arrangement of the carrying threads for the most part depend on the strengths of the materials and are always to be viewed under the already mentioned aspects that there should be equally good handling of the web and easy severability into individual pieces.

Application of the invention is not limited to a single-ply web but also extends to two-ply knitted fabric which, depending on the purpose for which the individual pieces to be separated are to be used, (e.g. as partially ready-made garments in the form of pants, panty hose, T-shirts or the like), can be knitted in-line along the edges and/or crosswise, or can have separation lines running longitudinally. In this connection the separation lines are optically and/or mechanically detectable and are preferably placed the in one-ply sections between the two-ply sections.

A preferred illustration is a web from which elastic panties can be made according to German Patent No. P 30 04 469. In this case the leg openings are in one edge of the web and the body opening in another edge of the web and side seams are made by sections knitted into one another and running crosswise to the direction of the web. The transverse sections also provide optically and mechanically controllable sections for final separation or for preseparation. The crotch of the panties is formed by periodic interknitting of an edge between the leg openings.

The cited illustration represents an example in which a final ready-made product is produced by the process of final separation into individual pieces, a product that can be utilized, e.g., in the medical field. With the preseparation, according to the invention, the web can be suitable packed, e.g., wound on spools or folded in cartons, without handling and transportation problems arising, and can be torn off singly from the web with a little pull by the end user, as needed. By winding on spools a substantially increased density is attained, as a result of which transportation space and transportation costs can be reduced.

According to another example of application, partially ready-made panty hose are produced from two-ply web in which, however, the course of the legs extends in the longitudinal direction of the web. In this case, the legs are made by periodic unstitching of the two-ply material in longitudinal direction, whereby the corresponding longitudinal edges are knitted together at the same time. Since such partially ready-made panty hose must be further worked on in the foot area and optionally also in the waist area, the process according to this invention, especially the further conveying and the further processing, is facilitated since the web according to the invention is automatically packed and conveyed and can be continuously drawn into additional processing stations. However, here, too, the separation is done according to the invention and can take place automatically or manually in a final process step.

It is an object of the invention to provide a novel product and a process adapted to it by which the separation of a textile web into partially or fully ready-made individual pieces can be simplified and made less costly without having the drawbacks in handling the products during further processing or during conveying.

The object is achieved by a web which includes a first type of fiber which forms the major portion of the threads or loops running in the direction of the web, and can be thermoplastically formed and separated at a first raised temperature, and a second type of fiber which forms a minor portion of the threads or loops running in the direction of the web and which remain structurally essentially unchanged at the first raised temperature.

It is also an object to provide a process which is distinguished by the fact that in a first process step following the weaving or knitting process, the fibers of the first type of thermoplastic fiber can be separated by heating in a section lying crosswise to the course of the web, and that in a second process step (preceding further processing and/or the end use), the thermally more resistant fibers of the second type of fiber (in the section lying crosswise to the course of the web that was previously heated) are separated.

With the above and other objects in view, more information and a better understanding of the present invention may be achieved by reference to the following detailed description.

DETAILED DESCRIPTION

For the purpose of illustrating the invention, there is shown in the accompanying drawings a form thereof which is at present preferred, although it is to be understood that the several instrumentalities of which the invention consists can be variously arranged and organized and that the invention is not limited to the precise arrangements and organizations of the instrumentalities as herein shown and described.

In the drawings, wherein like reference characters indicate like parts:

The process according to the invention proceeds so that immediately after the weaving or knitting process, in a step used for preseparation by means of a suitable device, all thermoplastic fiber portions, of a kind that can be changed at a relatively low temperature, are separated in a periodic sequence crosswise to the direction of the web by heating and melting. In a second process step, which is performed preferably mechanically by tensile load, the final severing occurs into partially ready-made and fully ready-made individual pieces by separating the remaining fiber portions of a second kind that have remained unaffected. Alternatively, the final separation may occur by subjecting the remaining fibers to a higher temperature. This may, e.g., be advantageous to cut off a specific length of the web after a desired number of individual pieces have been made ready for conveying or packing or distribution. The device for preseparation is controlled in an advantageous and preferred manner, together with the knitting device or independent of it. This also applies of course to the possible device for final separation.

Suitable devices with which the preseparation process can be carried out are known and may comprise, e.g., a simple hot wire, a cutter heated by an incorporated coil or the like. This is especially true when it is possible to bring the separation tool and the web closer together relative to one another. The kind of further processing and the conveying steps completely depend on the type of product to be produced. In this connection the advantages of the invention are always utilized to the maximum extent if the final separation process can take place by purely manual tensile load and leads to the fully ready-made product.

Figure 1:
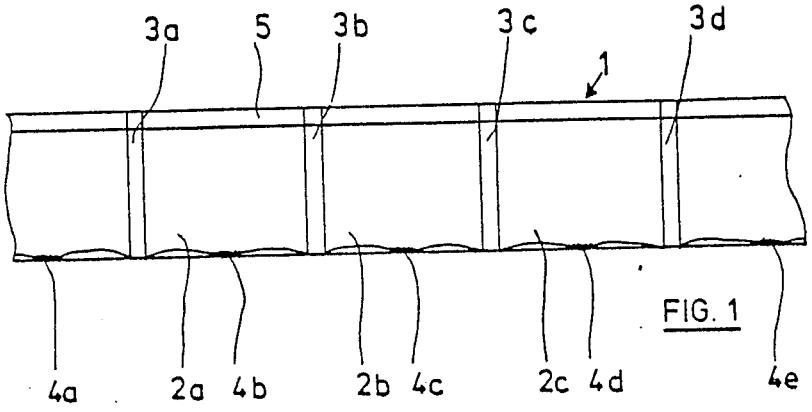
FIG. 1 shows a textile web as starting material for elastic panties.

FIG. 1 shows a two-ply web 1 made of knitted material, which is formed into individual partially ready-made elastic panties 2*a* to 2*c*. The individual panties are separated from one another by optically or mechanically controllable separation sections 3*a* to 3*d*, in which the two-ply material is knitted together to one ply and from which, after separation, side seams of the panties result. The side edges of the two-ply web are connected to one another solely in edge lengths 4*a* to 4*e*, whereby in each case the crotch and the leg openings are formed. Opposite edge section 5 is knitted by using elastomeric threads and thus forms in each case an elastic wasitband after separation of the individual pieces.

Figure 2:
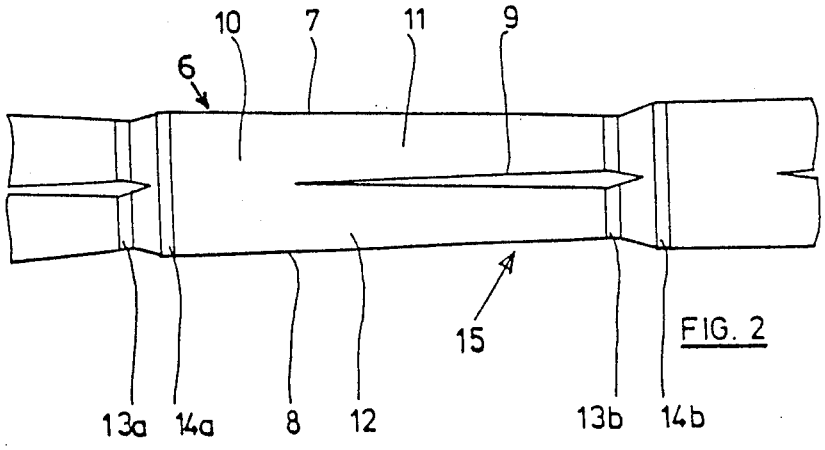
FIG. 2 shows a textile web as starting material for panty hose.

FIG. 2 also shows a two-ply web 6 made of textile material which is formed into individual intermediate products for elastic panty hose which extend essentially in the web's longitudinal direction. The mating plys are connected to one another, expecially knitted with one another, along their entire edge sections 7, 8. In each case periodically stitchings 9 running lengthwise are provided, along whose boundaries the two plys are also completely connected to one another. Thus edges 7 and 8 form exterior seams and the edges along the stitching 9 form interior seams of the panty hose to be produced. In this way a trunk portion 10 and leg portions 11, 12 of partially ready-made panty hose 15 are formed. As examples, intermittent separation sections are shown. The separation sections batches 13*a*, 13*b* are in the leg portions, and separation sections 14*a*, 14*b* are in the trunk portions. Consequently, the final separation can be provided in two phases depending on the requirements of further production and of the completely ready-made product. A portion of waste material results between sections 13*a* and 14*a* and between sections 13*b* and 14*b*.

Figure 3:
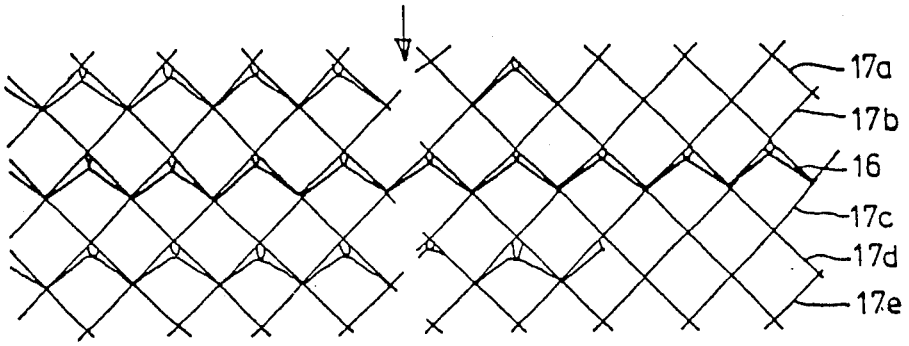
FIG. 3 shows a simplified and enlarged knitted fabric length with carrying threads and fusible threads with a section subjected to a first process step.

FIG. 3 shows a knitted fabric in the area of a separation section, whereby a thermally resistant carrying thread shown as 16 and fusible threads that can be thermoplastically severed are shown as 17*a* to 17*e*. All in all, the intact fabric is shown after the knitting, while the result of the preseparation is recognizable at the line identified by an arrow at which the fusible threads are destroyed and the carrying thread is unchanged.

Figure 4:
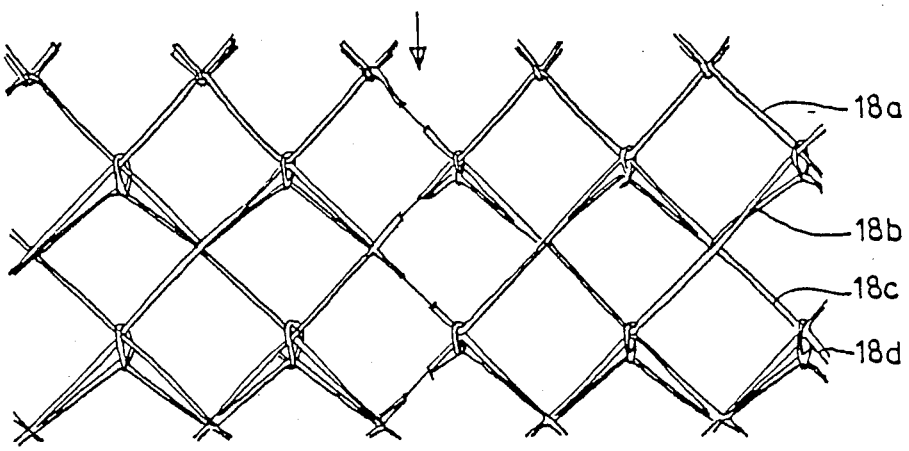
FIG. 4 shows a simplified and enlarged knitted fabric section with mixed-fiber or bi-component threads with a section subjected to the first process step.

In FIG. 4 once again a knitted fabric is shown after the knitting process with a line identified by an arrow after the first process step. All threads 18*a* to *d* are bi-component in structure and have portions that can be thermally severed and portions that are thermally resistant, especially in their core area. After the first process step of the preseparation the sheath is melted away in every thread along a separation line, while the thermally resistant core continues to carry and hold the web together and absorb nondestructively the usual tensile loads that occur during the usual further conveying and further processing.

Figure 5:
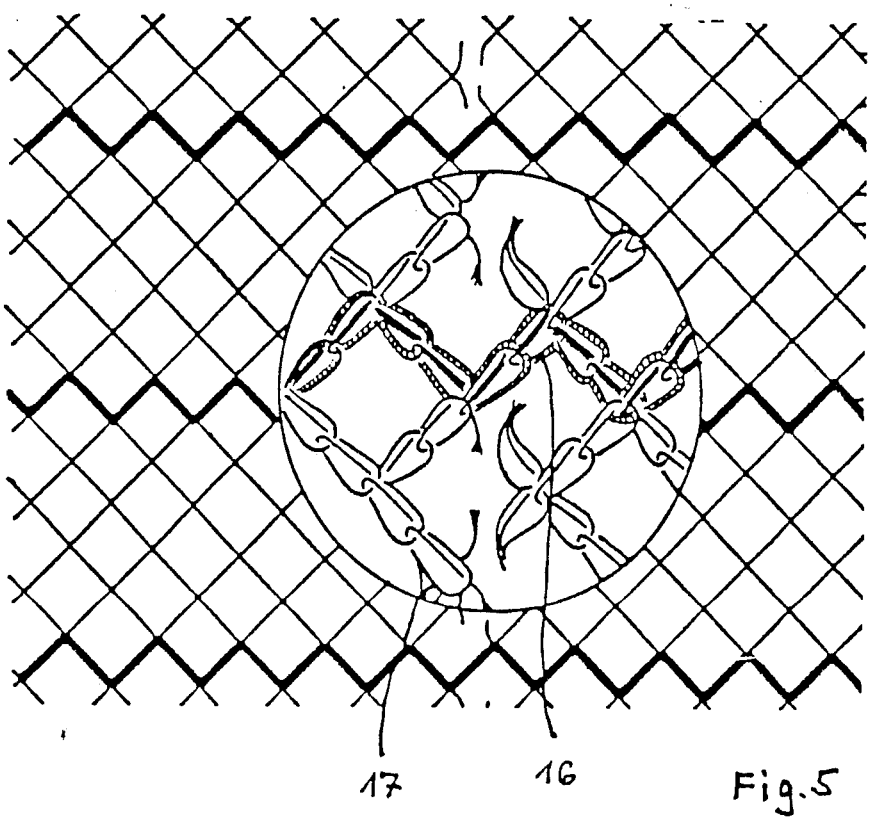
FIG. 5 shows a cut-out of a knitted fabric in enlarged representation.

FIG. 5 shows an enlarged detail of knitted fabric with a carrying thread 16 and a fusible thread 17.

It is to be understood that the present invention may be embodied in other specific forms without departing from the spirit or special attributes hereof, and it is therefore desired that the present embodiments be considered in all respects as illustrative, and therefore not restrictive, reference being made to the appended claims rather than to the foregoing description to indicate the scope of the invention.

Having thus described my invention, what I claim as new and desire to protect by Letters Patent are the following:

1. A web of partially ready-made or fully ready-made garments consisting of woven or knitted threads, said garments separated from each other by an integral web section made at least in part of bi-component fibers, said fibers having a portion which remains intact under localized heat, and a portion which disintegrates under said localized heat, said web remaining intact but weakened when one portion of said fiber is disintegrated by heat.

2. The web of claim 1 wherein said fibers consist of an integral center core which is the portion which remains intact under localized heat and also consists of a tubular sheath portion surrounding said core which tubular sheath is the portion which disintegrates under said localized heat.

* * * * *